US011528979B2

(12) United States Patent
Rubin

(10) Patent No.: US 11,528,979 B2
(45) Date of Patent: Dec. 20, 2022

(54) HAIR ACCESSORY FOR MAINTAINING PREVIOUSLY STYLED HAIR

(71) Applicant: Rachael Rubin, Framingham, MA (US)

(72) Inventor: Rachael Rubin, Framingham, MA (US)

(73) Assignee: Sleepy Tie, Inc., Framingham, MA (US)

( * ) Notice: Subject to any disclaimer, the term of this patent is extended or adjusted under 35 U.S.C. 154(b) by 38 days.

(21) Appl. No.: 16/935,070

(22) Filed: Jul. 21, 2020

(65) Prior Publication Data

US 2022/0022619 A1 Jan. 27, 2022

(51) Int. Cl.
*A45D 8/34* (2006.01)

(52) U.S. Cl.
CPC ..... *A45D 8/34* (2013.01)

(58) Field of Classification Search
CPC . A45D 2/02; A45D 2/125; A45D 2/20; A45D 2/18; A45D 8/00; A45D 8/004; A45D 8/36; A45D 8/34
USPC ..... 132/273
See application file for complete search history.

(56) References Cited

U.S. PATENT DOCUMENTS

| | | | | |
|---|---|---|---|---|
| 889,873 | A | 6/1908 | Damon | |
| 4,648,414 | A * | 3/1987 | Fox | A45D 2/18 132/246 |
| D292,030 | S | 9/1987 | Revson | |
| 5,230,355 | A | 7/1993 | Weingrod | |
| D343,949 | S | 2/1994 | Weingrod | |
| D344,176 | S | 2/1994 | Lawrence | |
| 5,293,884 | A | 3/1994 | Chapman | |
| 5,301,696 | A * | 4/1994 | Revson | A45D 8/34 132/273 |
| 5,413,126 | A | 5/1995 | Revson | |
| D362,738 | S | 9/1995 | Marrese et al. | |
| 5,494,059 | A | 2/1996 | Barrows | |
| 5,727,574 | A | 3/1998 | Frye | |
| 5,816,265 | A | 10/1998 | Ringo | |
| 5,826,593 | A | 10/1998 | Haubrich | |

(Continued)

FOREIGN PATENT DOCUMENTS

| | | | |
|---|---|---|---|
| DE | 102015115002 | B3 | 7/2016 |
| EP | 0721747 | A1 | 7/1996 |

(Continued)

OTHER PUBLICATIONS

Dreamy Curls, create amazing hairstyles with our headbands to (yourdreamycurls.com) Mar. 22, 2018 (Mar. 22, 2018) Entire document, especially figs 2-3.

(Continued)

*Primary Examiner* — Cris L. Rodriguez
*Assistant Examiner* — Sydney J Pulvidente
(74) *Attorney, Agent, or Firm* — Mintz Levin Cohen Ferris Glovsky and Popeo, P.C.

(57) ABSTRACT

The present disclosure relates to hair accessories and more specifically to a hair accessory for maintaining previously styled hair. In accordance with aspects and embodiments, a hair accessory is provided having a stretchable loop and an arc affixed perpendicularly to the stretchable loop. A user can pull styled hair through the stretchable loop, wrap the styled hair concentrically around the arc, and secure the accessory in the hair such that the hair is up but is able to be returned to its previously styled state by removing the accessory.

12 Claims, 8 Drawing Sheets

(56) References Cited

U.S. PATENT DOCUMENTS

| | | | | |
|---|---|---|---|---|
| D402,082 | S | 12/1998 | Lee | |
| D414,297 | S | 9/1999 | Maturaporn | |
| 6,047,708 | A | 4/2000 | Panel | |
| 6,161,246 | A | 12/2000 | Trachtenberg | |
| D445,957 | S | 7/2001 | Maturaporn | |
| 6,260,555 | B1 * | 7/2001 | Natvig | A45D 8/34 132/273 |
| D449,134 | S | 10/2001 | Maturaporn | |
| D481,239 | S | 10/2003 | Otoole et al. | |
| 6,799,581 | B2 * | 10/2004 | Cave | A45D 8/34 132/273 |
| 6,959,713 | B2 | 11/2005 | Silva | |
| D581,097 | S | 11/2008 | Herman | |
| D619,761 | S | 7/2010 | Guerrero | |
| D698,996 | S | 2/2014 | Krasniansky | |
| 9,795,197 | B2 | 10/2017 | Rizzuto | |
| 2004/0055614 | A1 | 3/2004 | Cave | |
| 2004/0211439 | A1 | 10/2004 | Silva | |
| 2006/0021630 | A1 | 2/2006 | Lafauci | |
| 2006/0042649 | A1 | 3/2006 | Anzevino | |
| 2012/0174942 | A1 | 7/2012 | Carey | |
| 2013/0186420 | A1 | 7/2013 | Oates | |
| 2014/0096788 | A1 | 4/2014 | Krasniansky | |
| 2015/0250280 | A1 * | 9/2015 | Van Der Veur | A45D 7/02 132/229 |
| 2017/0112252 | A1 | 4/2017 | Campbell | |
| 2018/0055180 | A1 | 3/2018 | Marcin et al. | |
| 2019/0133288 | A1 | 5/2019 | Corra et al. | |
| 2020/0375332 | A1 | 12/2020 | Cordina | |
| 2021/0015233 | A1 | 1/2021 | Durham | |
| 2022/0022620 | A1 | 1/2022 | Rubin | |
| 2022/0295961 | A1 | 9/2022 | Rubin | |

FOREIGN PATENT DOCUMENTS

| | | | |
|---|---|---|---|
| WO | 2006134478 | A2 | 12/2006 |
| WO | 2022020290 | A1 | 1/2022 |
| WO | 2022133024 | A1 | 6/2022 |

OTHER PUBLICATIONS

Hair Roller by Dreamy Curls—No Heat Sleep In Curler with Button—High Quality Velvet Super Soft Memory Foam Headband for Heatless Hairstyling—Ideal for Long and Medium Hair (TWIRLY) to (Dreamy Curls) Jun. 10, 2019 (Jun. 10, 2019). Entire document, espcially figs 2-5 https://www.amazon.co.uk/dp/B07SW5ZW58?ref=myi_lit1e_dp&th=1.

Heatless curls using Only Scrunchies! Fail or Success? Best overnight cur1s? Easy curls at home! (Priscilla Mariah) May 17, 2020 (May 17, 2020) [onjline) retrieved from: <URL: https:/lwww.youtube.com/watch?v=IUNXT1hu-Vw> entire Video, especially timestamps [1:37, 1:55, and 2:14].

(Dec. 31, 2020) Heatless Hair—Get Curls without Heat with The Curling Ribbon, Accessed Dec. 31, 2020, htlps://heallesshair.com/, 6 pages.

(Apr. 1, 2020) Satin Heatless Curling Set—Sunset Tie Dye (KITSCH) Apr. 1, 2020 (Apr. 1, 2020), retrieved from internet Feb. 8, 2022;URL= <https://mykitsch.com/products/satin-heatless-curling-set-sunset -y -tie-dye?variant-40634532724917>.

(Jul. 25, 2020) Mirsalehi Negin, "@negin_mirsalehi's heatless beach curls", https://www.instagram.com/p/CDEejA6Dq4W/?gshid=1s2u7styyonm7, Gisou, 2 pages.

* cited by examiner

HAIR ACCESSORY FOR MAINTAINING PREVIOUSLY STYLED HAIR

FIELD OF DISCLOSURE

The present disclosure relates to hair accessories, and more specifically, to a hair accessory for wearing while sleeping to maintain previously styled hair. The disclosed hair accessory advantageously allows a user to style their hair in the evening, sleep comfortably with their hair in the accessory, and remove the accessory in the morning to return their hair to the styled state without the need for further styling, reducing the time spent on getting ready for the day.

BACKGROUND

Time-saving products have always been popular, but as people work longer hours and have more obligations outside of the home, products designed to save time in consumers' morning routines continue to rise in popularity. The cosmetic and beauty industry, in particular, has become increasingly focused on creating products that offer users premium results in less time, allowing busy users to create optimal results while in a morning rush or while on the go.

One area of personal care that remains time-intensive is hair care. Those with medium hair or longer that requires styling generally must wake up early enough to fully wet and dry their hair and style it as desired. This process is time intensive. While some individuals with certain hair types can style their hair the evening before, sleeping on styled hair often causes the style to become undone such that further work and effort must be put into correcting the style in the morning. Moreover, many individuals with longer hair prefer to sleep with their hair up, either in a ponytail or chignon, and tying the hair up in this manner can cause indents in the hair that cannot easily be corrected.

There thus exists a need for a hair accessory that enables individuals to style their hair in the evening and tie up their hair in the accessory for comfortable sleeping such that the accessory also preserves the hair style and avoids crimping the hair. In the morning, the individual can remove the tie, returning their hair to its previously styled state for a quick and easy morning.

SUMMARY OF DISCLOSURE

The present disclosure relates generally to hair accessories, and more specifically, to hair accessories styling, or maintaining previously styled hair. In accordance with aspects and embodiments, a hair accessory is provided comprising a stretchable loop and an arc, where the arc has a first end and a second end attached to the stretchable loop. The arc is affixed to the loop perpendicularly. The stretchable loop may be a traditional scrunchie and may comprise an elastic encased by fabric. The arc comprises a foam core having a circular cross section. The foam core is also encased by a smooth fabric. In some embodiments, the scrunchie fabric and the arc fabric may be the same. In other embodiments, the scrunchie fabric and the arc fabric may be different. The fabric on both the scrunchie and the arc is preferably a silk or a satin. In some embodiments, the arc may further include a wire for support.

In accordance with aspects and embodiments, the hair accessory is used in a method of maintaining previously styled hair. The method includes the steps of styling hair with, for example, a blow drier to achieve a desired hair style, and then pulling the styled hair through the stretchable loop, i.e., the scrunchie of the hair accessory. Next, the free hair pulled through the scrunchie is wrapped concentrically around the arc. The scrunchie is then stretched outward, perpendicularly away from the arc, and twisted into a figure eight, creating a first loop where the hair is and a second, empty loop. The empty loop is then stretched over the arc to secure the hair and accessory in place. A user can sleep with the accessory in their hair or wear the accessory for as long as desired and then remove the accessory to return their hair to its previously styled look. The accessory advantageously allows the hair to be pulled up without creasing freshly styled hair, with allows for both comfortable sleeping and saves time when getting ready in the morning.

In accordance with aspects and embodiments, a hair accessory kit is provided comprising at least one hair accessory and instructions on how to use the accessory to achieve best results. In some embodiments, more than one hair accessory may be provided. For example, a kit may comprise two hair accessories, the first hair accessory having an arc of a first size and the second hair accessory having an arc of a second size. The difference in arc sizes may accommodate different hair lengths. Alternatively, one arc size may maintain straight hair and a smaller arc size which facilitates more concentric wrapping may result in a wave or curl when the accessory is removed. The hair accessory kits may further include styling products to assist users in achieving best results with the disclosed hair accessories.

DETAILED DESCRIPTION

Figure 1:
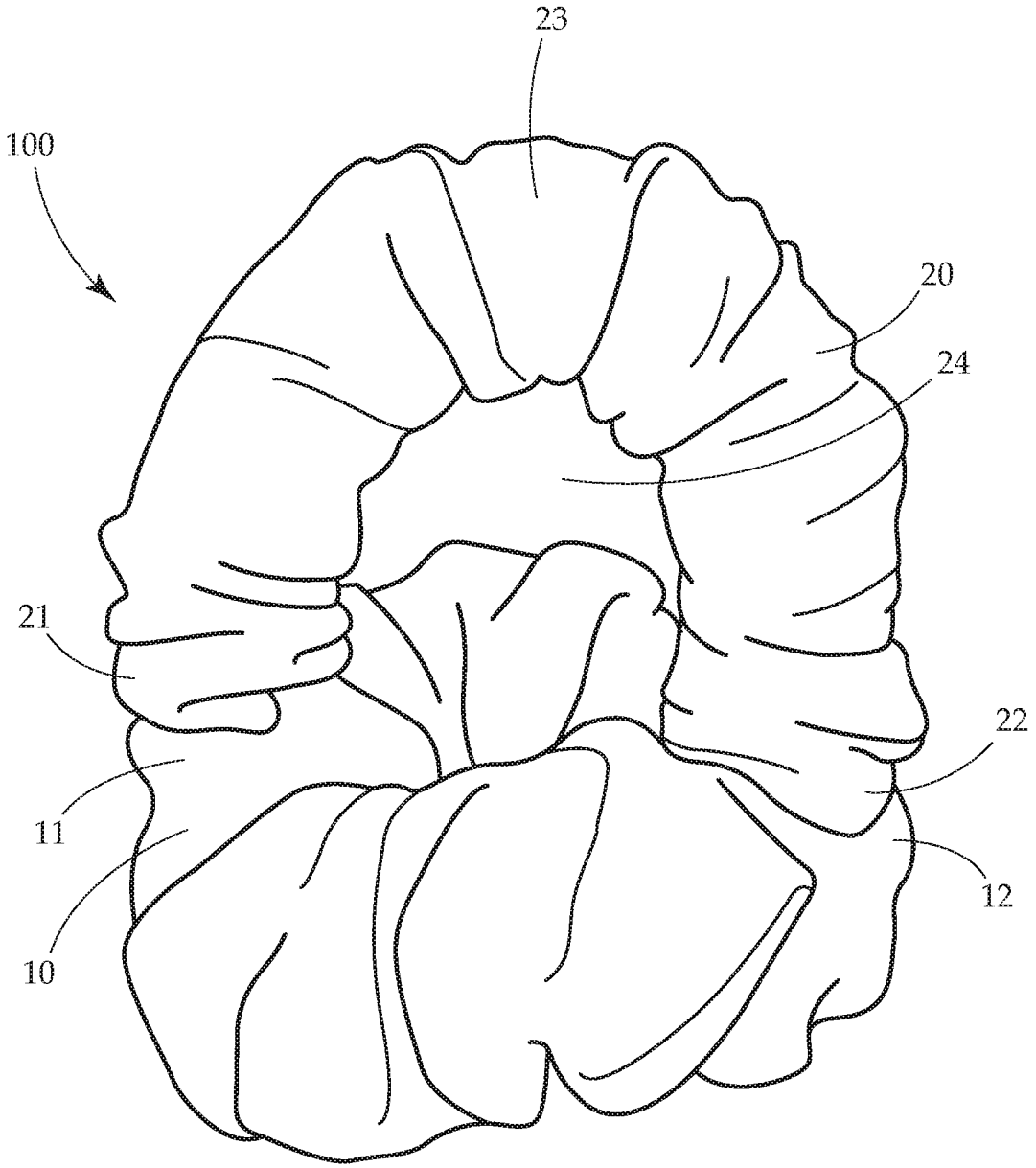
FIG. 1 shows a hair accessory in accordance with aspects and embodiments.

Many individuals spend a significant amount of time, effort, and money on their appearance to achieve a certain look and/or present a certain image to outward onlookers. This image/persona is usually reflective of one or more traits important to the individual's identity, and may include characteristics like, "stylish," "put together," "professional," "successful," or any number of other qualities one may be able to convey through appearance.

Beyond dress, grooming and hygiene plays a significant role in how individuals are perceived. For this reason, many individuals engage in a regular personal hygiene and grooming routine to maintain an appearance that conforms with the physical image they wish to present. For many, maintaining well-styled hair is integral to this routine and central to their appearance.

Medium length and longer hair of all types may be styled and worn in a number of ways. A common hair style worn by those having hair of this length, where "medium length" is approximately shoulder length, is "down." That is, the hair is not tied up, pulled back, or otherwise restricted by an accessory. Alternatively, the hair may be partially tied up, such that some portion of the hair is pulled up and/or back away from the face, and secured behind an ear or at the back of the head, such that an upper-most layer of hair does not interfere with daily activities. Still further, hair may be secured in a ponytail, i.e., the entirety of the hair is fully pulled back and secured at the back of the head but allowed to hang freely from the accessory securing it. Other styles stem from ponytail-like configurations, including chignons, also referred to as "buns". Other, more complicated styling like braiding, French braids, and French twists, though less common as an everyday style, can be seen in workplaces, in streetwear fashion, and in formal attire settings.

Typically, medium length and longer hair is worn by women. However, some men also wear their hair at longer lengths. As referred to herein, "hair" means any head hair and may be head hair of any length able to be secured by the presently disclosed accessory. The disclosed accessory may be suitable for hair of a variety of lengths, including hair that is shorter than hair of "medium" length, and may for example, be suitable for hair having a length of "ear height/length." Hair referred to in the present disclosure may be hair of any texture and of any thickness. For example, the hair referred to herein may be fine or thick, straight, or curly. The hair referred to in the present disclosure may be on the head of any individual regardless of sex, or gender. Moreover, the presently disclosed accessory may be suitable for the styling of synthetic hair worn as a prosthesis, worn for fashion, or worn for any other reason.

Many hair styles, regardless of length, begin the styling process with clean, blow-dried hair. Achieving clean, blow-dried hair generally involves wetting the hair completely, shampooing and applying detangling and/or conditioning treatments as desired, towel drying the hair, combing the wet hair to remove any knots and tangling, and using a blow dryer, usually with the aid of a brush, to then dry the hair. This process may vary depending on hair texture. For example, individuals with curly hair may use a diffuser and their fingers during blow-drying, rather than a brush, to achieve smooth, bouncy, curls, as the end product. Styling products may be introduced to the hair at any point in the process but are most generally applied after towel drying and after fully drying the hair.

Most individuals with medium length hair or longer who blow dry their hair as part of their grooming routine do so after taking a shower. The drying process can be time intensive, particularly if the hair is thick or long. For these reasons, some individuals elect to shower and blow dry their hair in the evening to save time in their morning routine. However, maintaining the blow-dried style achieved in the evening throughout the night can be challenging. This presents a conundrum: style the hair in the evening and risk waking up with messy hair or plan on waking up earlier than desired to perform the entire styling routine in the morning.

One of the complicating factors that contribute to maintain hair styles overnight is that individuals with longer hair lengths often prefer to sleep with their hair pulled up. This offers more comfort during sleep, ensuring that the hair does not brush across the face or wrap around the neck during sleep. In particular, those with longer hair often report that sleeping with their hair down causes them to become hot. However, pulling the hair up, which is typically done with some form of an elastic, often leaves a crease or dent in the hair. Creases and dents left in hair by elastics are difficult if not impossible to remove without complete restyling. Alternatively, even when hair is left down for sleeping, the friction of the hair on a pillow throughout the night can cause knotting, tangling, and crimping that can also prove to be irreversible in the morning.

The presently disclosed accessory advantageously allows a user to tie their blow-dried hair up in an accessory, leave the hair in the accessory for any amount of time, and when the accessory is removed, the hair will be as it was before it was tied into the accessory. That is, the disclosed accessory allows a user to secure their hair without causing creases, kinks, knots, or other imperfections that ruin their blow-dried styling. A user of the present invention can thus blow dry their hair in the evening, use the disclosed hair accessory for comfortable sleeping, awake, remove the accessory, and reveal perfectly blow-dried hair in the morning. The accessory advantageously saves precious morning time while preserving previously blow-dry styled hair. A user can then further style their hair as desired, or, if clean, fresh, blow-dried style was the end-style desired, simply move on with the rest of their morning routine.

The presently disclosed accessory also finds use in situations other than sleeping and for example, when blow-dried styling is desired but the gap in time between when blow-drying is performed and when the styling is desired for wear is a long period of time. As an example, many brides and bridesmaids are asked to arrive to hair, nails, and makeup with freshly blow-dried hair. However, the time when they are asked to arrive and the time when their hair is styled (or the time when which they wear their hair down, i.e., when walking down the aisle) is often hours later than their arrival time for hair, nails, and makeup. It is often inconvenient for them to wear their hair down for the entire duration of makeup and other preparations. The present accessory offers individuals in these and similar situations with a solution that allows the hair to be pulled up while fully preserving the blow-dried style.

In accordance with aspects and embodiments, an accessory is provided that collects the hair loosely in a smooth, fabric encased circular elastic, such that the hair does not become creased by pressure exerted on the hair by the elastic. The circular elastic has a semi-rigid U-shaped bridge, i.e., an arc, having a circular cross section. The arc is connected perpendicularly to the circular elastic. Hair passed through the elastic is wrapped around the arc in a circular motion until the entirety of the hair is wrapped around it. The circular elastic is then pulled in a direction perpendicular to the arc and twisted, such that a figure eight is formed and an empty loop is created. The empty loop is then stretched up and over the arc to secure the hair and accessory in place. The concentric wrapping of the hair around the arc ensures that the hair does not crease while in the accessory. The accessory, including the arc, is further sized to ensure that the hair wrapped around the arc does not gain a curl when held in the accessory. When removed, the hair is returned to the state in which it was prior to being placed into the accessory.

An accessory in accordance with aspects and embodiments is shown in FIG. 1. Accessory 100 has scrunchie 10 and arc 20. Arc 20 has first end 21 connected to scrunchie 10 at 11 and second end 22 connected to scrunchie 10 at 12. Arc 20 extends perpendicularly from scrunchie 10 and has an apex 24 having a height 23 from scrunchie 10.

Figure 2:
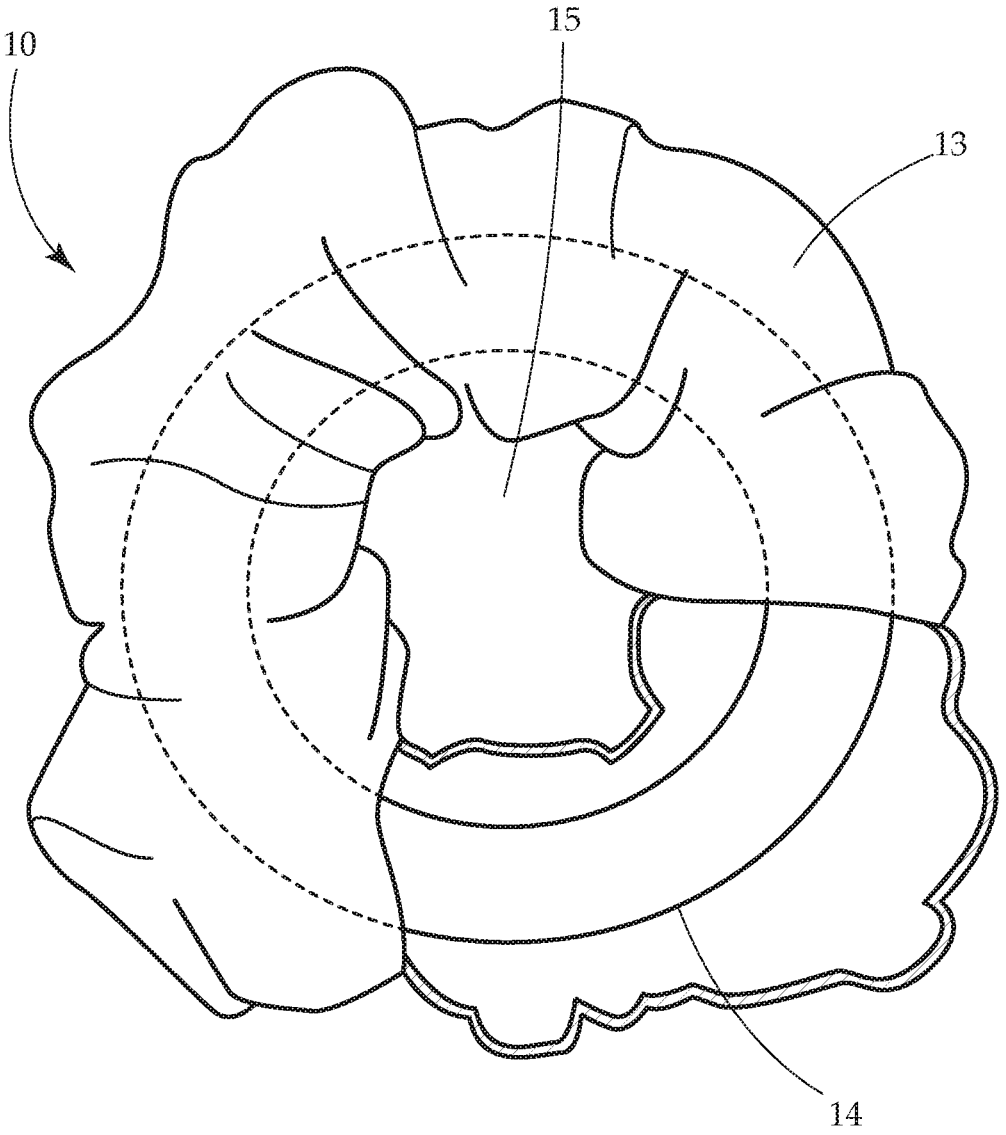
FIG. 2 shows a portion of a hair accessory in accordance with aspects and embodiments.
Figure 3A:
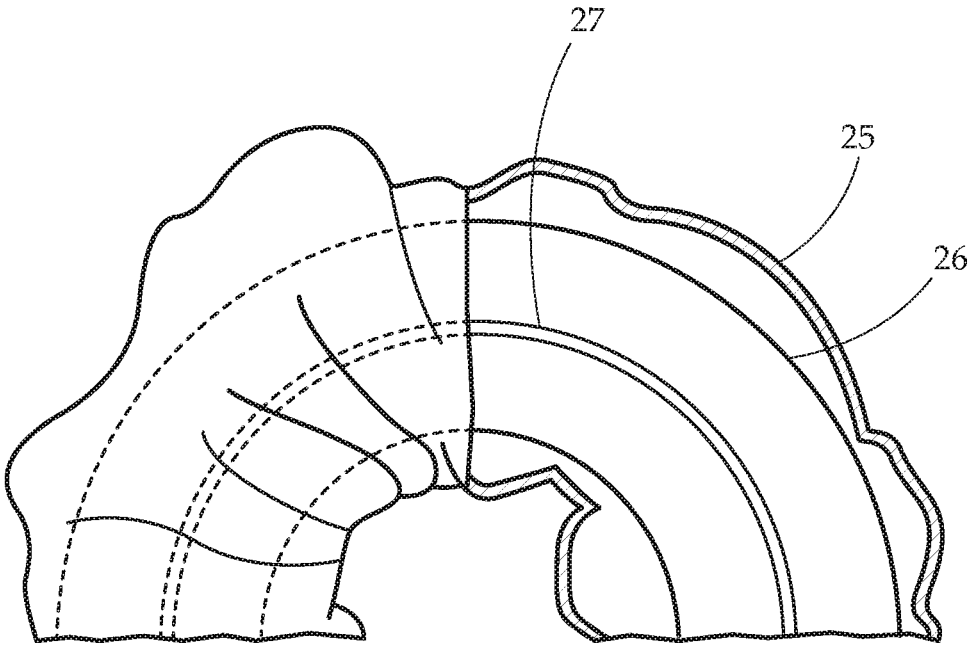
FIGS. 3A-3B show a portion of a hair accessory in accordance with aspects and embodiments.
Figure 3B:
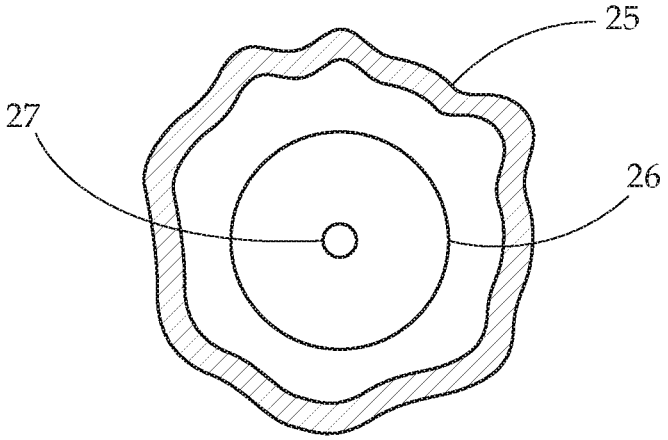
Figure 4A:
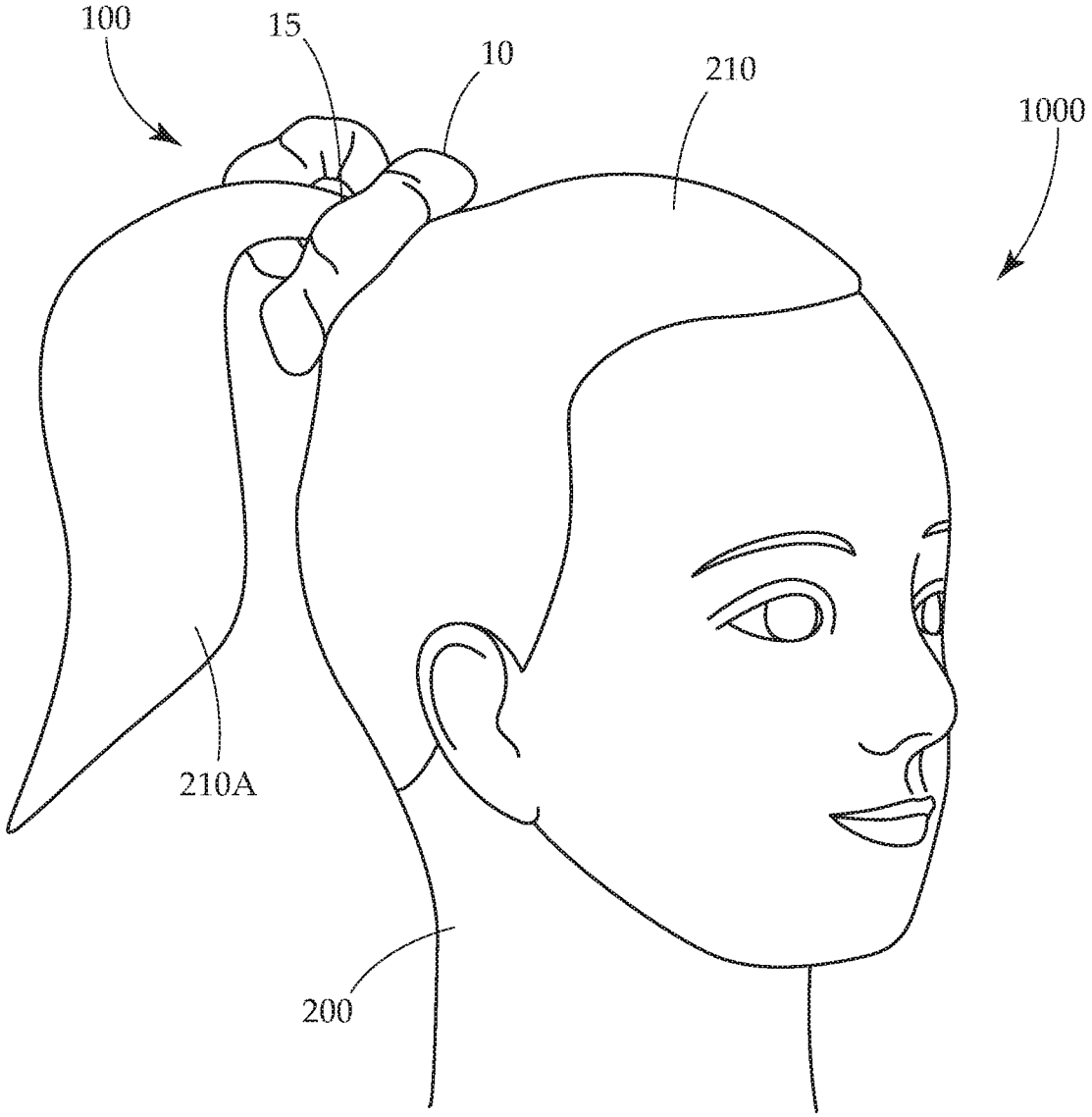
FIGS. 4A-4F show use of a hair accessory in accordance with aspects and embodiments.
Figure 4B:
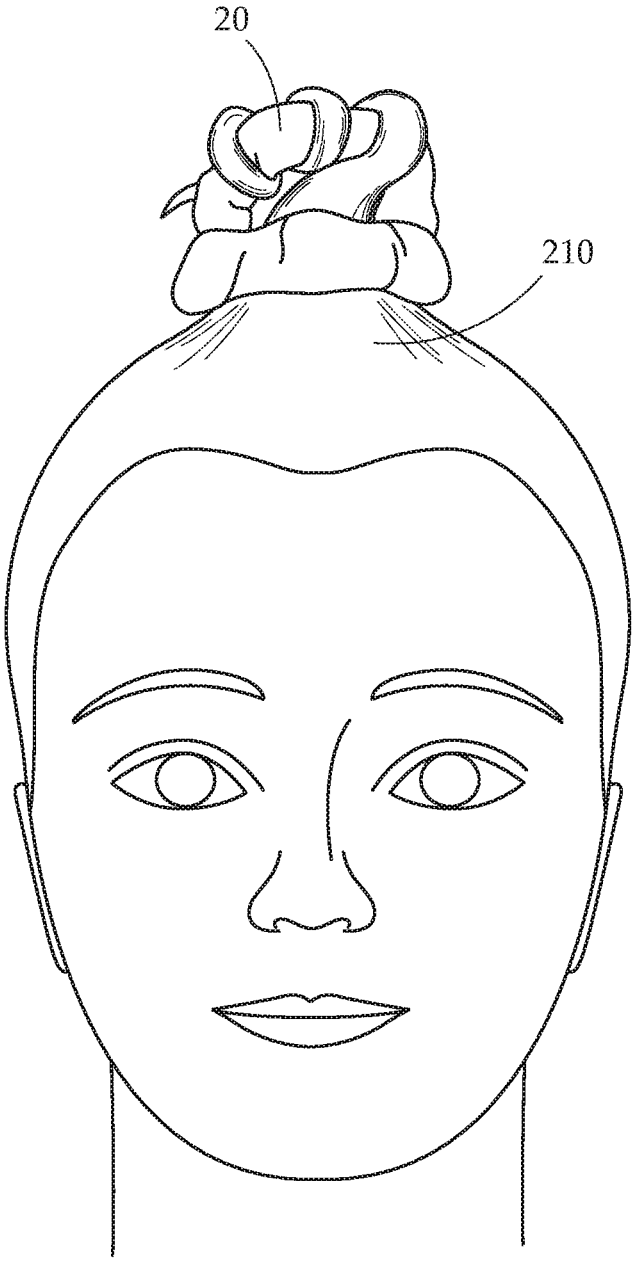
Figure 4C:
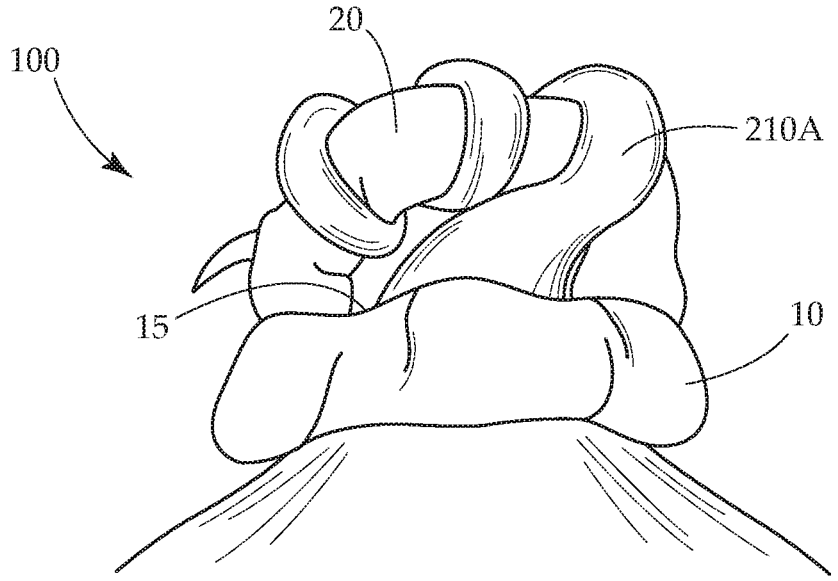
Figure 4D:
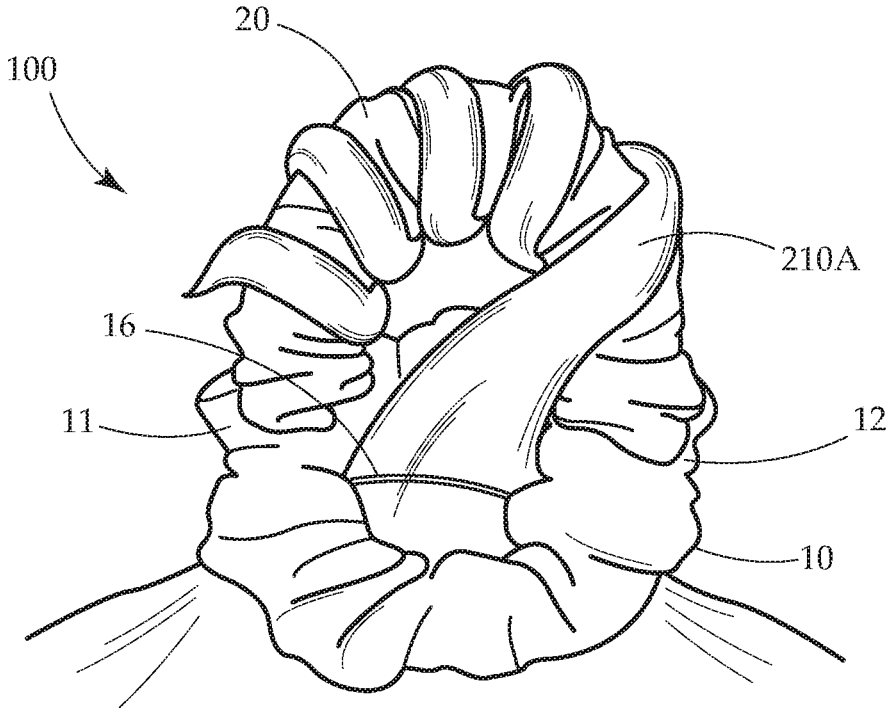
Figure 4E:
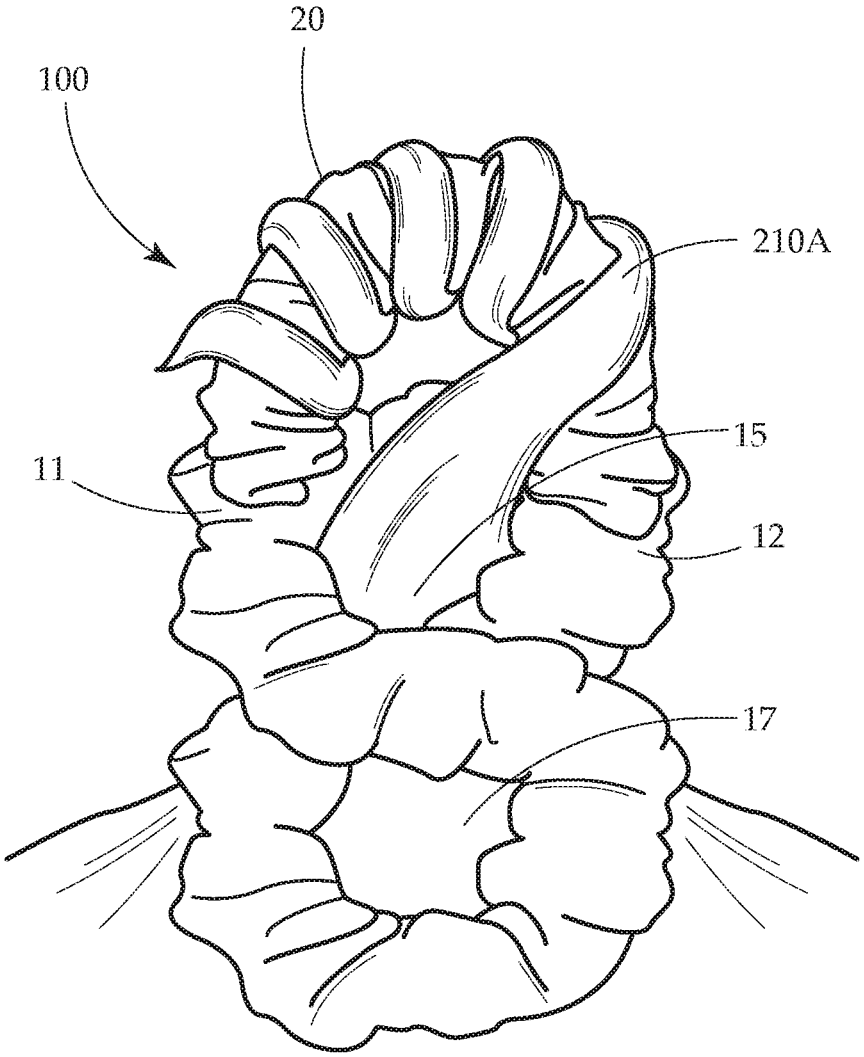
Figure 4F:
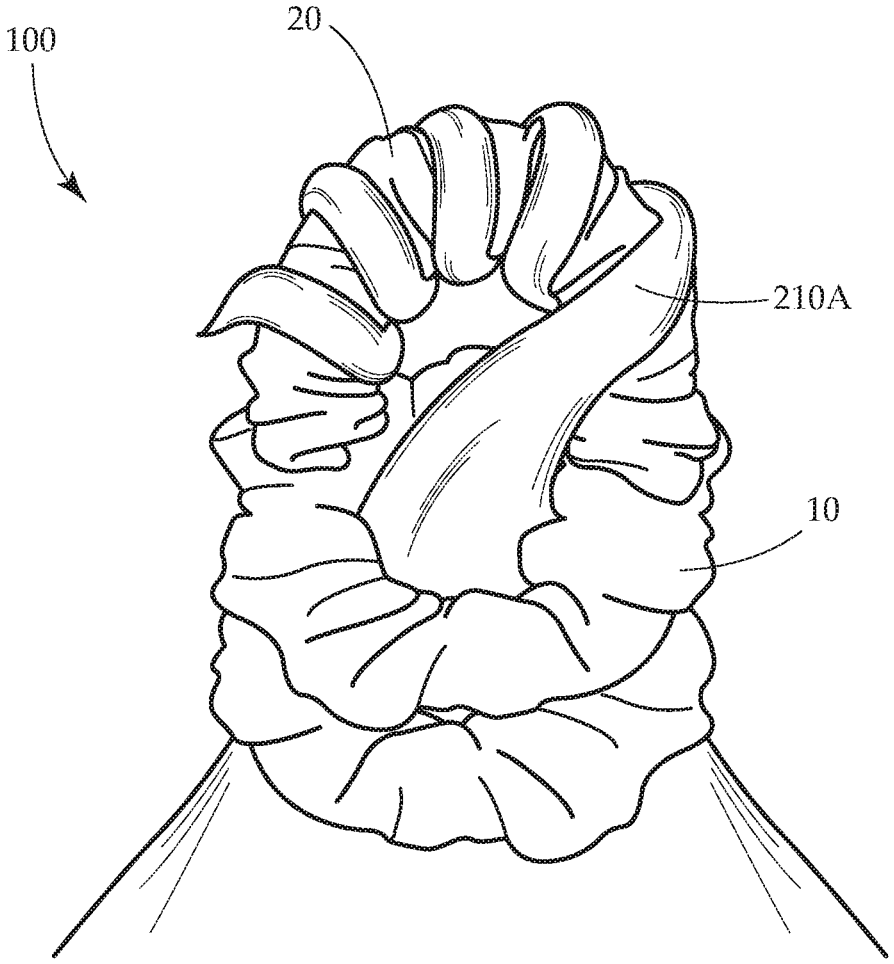

Referring also to FIG. 2, scrunchie 10 is circular, forming loop 15. Scrunchie 10 has casing 13 surrounding elastic 14. Casing 13 may be made of any fabric and is preferably made of a smooth fabric over which hair glides easily, like a silk or satin. Referring also to FIGS. 3A-3B, arc 20 has circular foam core 26 with semi-rigid wire 27 at its center. Wire 27 aids foam core 26 in maintaining its shape. In some embodiments, wire 27 may be omitted. In other embodiments, foam core 26 may have a shape other than circular, and may for example, be oval. Foam core 26 having wire 27 therein is encased by casing 25. Casing 25 is made of fabric and may be made of the same or different fabric as scrunchie casing 13 but is also preferably made of fabric over which hair glides easily, like a silk or satin. The same type of material may be used for both portions of the accessory, but different prints may be employed for scrunchie 10 and arc 20 for an aesthetically interesting and pleasing product. Arc 20 is securely connected to scrunchie 10 by stitching the free ends of casing 25 surrounding core 26 to casing 13 of scrunchie 10. Suitable fabrics for casings 13 and 25, elastic for scrunchie 10, and materials for the core of arc 20 will be readily ascertained by those of skill in the art.

Referring now to FIGS. 4A-4F, use of accessory 100 will be discussed. User 200 with hair 210 pulls hair 210 back and through loop 15 of scrunchie 10 of accessory 100. User 200's free hair 210A hangs from scrunchie 10 as if in a ponytail, but the hair is not tightly bound by scrunchie 10. Loop 15 is loose around hair 210. User 200 then wraps free hair 210A around arc 20 of accessory 100 repeatedly until the full length of free hair 210A is wrapped around arc 20. After hair 210A has been wrapped around arc 20, scrunchie 10 is pulled outward, perpendicularly to arc 20. Scrunchie 10 is pulled at a location between the connection points of arc 20, i.e., between points 11 and 12 of scrunchie 10, to create a larger opening 16 around the hair in scrunchie 10. Scrunchie 10 is then twisted at the bases 21 and 22 of arc 20 to create a second loop 17 in addition to loop in addition to hair-containing loop 15. Empty loop 17 is then stretched up and over arc 20 to secure accessory 100 in hair 210. After a night's sleep or when the user 200 is ready to access their hair, scrunchie 10 may be un-looped off of arc 20. Hair 210 can then be uncoiled off arc 20 and accessory 100 may be removed from hair 210 to reveal defect-free hair.

The combination of first pulling the hair through the loose scrunchie and wrapping it around a strategically sized circular core before wrapping the scrunchie into place ensures that the hair does not become dented as would be the case if a traditional hair elastic were used. The silkiness of the fabric casings on both the scrunchie and the arc further facilitate the maintenance of the original style by allowing hair to glide freely over the fabric without holding strands too rigidly in place. The accessory is also readily adaptable for different hair lengths by, for example, sizing both the scrunchie and arc accordingly. Longer hair may, for example, require a taller and thicker arc, whereas shorter hair may require a thinner, shorter arc. Hair thickness and texture may also factor into the selection of an appropriate arc core thickness to ensure a smooth end result.

For example and in accordance with aspects and embodiments, accessory 100 may be sized to accommodate hair of different lengths. Arc 20 may be enlarged, either in apex height 23, circumference of core 26, or both, for longer hair. Arc 20 may be reduced in size by the same metrics to accommodate shorter hair. Different hair textures may also benefit from different sized arcs to ensure that the hair coiled around the arc does not retain an undesirable curl. In accordance with embodiments, the size of scrunchie 10 may also be adjusted in accordance with adjustments made to the size of arc 20. In some embodiments, a first sized accessory may be used to ensure hair remains straight and a second accessory may be used to provide a curl or wave to hair. Alternatively, hair may remain straight when the accessory is placed in dry hair but may fix a curl into hair if the accessory is placed into slightly damp hair or if a hair spray or gel is applied to hair before or during the wearing of the accessory.

In accordance with aspects and embodiments, the disclosed accessories may be provided in a hair styling kit. The kits may include one or more accessories, and may for example, include a first accessory having a first size and a second accessory having a second size. Kits may further include styling products intended to be used with a particular accessory to enhance the results achieved when using the accessory. For example, when an accessory is selected to maintain a straight style, the kit may include instructions that direct the use of an included straightening and/or smoothing product prior to putting hair in the accessory. Alternatively, if an accessory is selected to maintain or achieve a wave or curl style, the kit may include instructions that direct the use of a light hold hair spray product after the accessory is placed in the hair. The kit may further include scrunchies having smooth casings of the type used in the accessory to assist users in maintaining indent-free hair should hair need to be placed up during the day.

While several variations of the present disclosure have been illustrated by way of example in preferred or particular embodiments, it is apparent that further embodiments could be developed within the spirit and scope of the present disclosure, or the novel concept thereof. However, it is to be expressly understood that such modifications and adaptations are within the spirit and scope of the present disclosure, and are inclusive, but not limited to the following appended claims as set forth.

What is claimed is:

1. A hair accessory comprising:

a stretchable loop formed entirely of a stretchable elastic, and an arc having a first end and a second end, wherein the first end of the arc and the second end of the arc are affixed to the stretchable elastic;

wherein the elastic is encased by a first fabric;

wherein the arc comprises a core encased by a second fabric;

wherein a first free end of the second fabric encasing the core is connected to the first fabric by a first stitching, and wherein a second free end of the second fabric is connected to the first fabric by a second stitching; and wherein the stretchable loop is formed into a figure eight.

2. The accessory of claim 1, wherein the arc is perpendicular to the stretchable loop.

3. The accessory of claim 1, wherein the first fabric and the second fabric are selected from the group consisting of silk and satin.

4. The accessory of claim 1, wherein the arc further comprises a wire.

5. The accessory of claim 1, wherein the first fabric and the second fabric are the same fabric.

6. A hair accessory kit comprising:

at least one hair accessory of claim 1; and instructions on how to use the at least one hair accessory.

7. The hair accessory kit of claim 6, where the first fabric is selected from one of silk and satin.

8. The hair accessory kit of claim 6, further comprising two hair accessories, a first hair accessory of the two hair accessories having an arc of a first size and a second hair accessory of the two hair accessories having an arc of a second size.

9. The hair accessory kit of claim 8, wherein the first hair accessory is for use on hair of a first length and the second hair accessory is for use on hair of a second length.

10. The hair accessory kit of claim 8, wherein the first hair accessory is for maintaining straight hair and the second hair accessory is for curling hair.

11. The hair accessory kit of claim 6, further comprising at least one hair styling product.

12. The hair accessory kit of claim 6, where the second fabric is selected from one of silk and satin.

* * * * *